US008835765B2

(12) United States Patent
Jiang et al.

(10) Patent No.: US 8,835,765 B2
(45) Date of Patent: Sep. 16, 2014

(54) FEP MODIFICATION USING TITANIUM DIOXIDE TO REDUCE SKEW IN DATA COMMUNICATIONS CABLES

(75) Inventors: Qibo Jiang, Ephrata, PA (US); Paul Kroushl, Lancaster, PA (US)

(73) Assignee: Nexans, Paris (FR)

( * ) Notice: Subject to any disclaimer, the term of this patent is extended or adjusted under 35 U.S.C. 154(b) by 189 days.

(21) Appl. No.: 13/150,387

(22) Filed: Jun. 1, 2011

(65) Prior Publication Data

US 2012/0024569 A1 Feb. 2, 2012

Related U.S. Application Data

(63) Continuation-in-part of application No. 12/846,880, filed on Jul. 30, 2010.

(51) Int. Cl.
*H01B 11/02* (2006.01)
*H01B 3/44* (2006.01)

(52) U.S. Cl.
CPC ..... *H01B 11/02* (2013.01); *H01B 3/445* (2013.01)
USPC ..... 174/113 R

(58) Field of Classification Search
USPC ..... 174/113 R, 110 R
See application file for complete search history.

(56) References Cited

U.S. PATENT DOCUMENTS 5,074,640 A * 12/1991 Hardin et al. ..... 385/109
5,619,016 A 4/1997 Newmoyer
5,814,768 A 9/1998 Wessels et al.
2005/0173674 A1 8/2005 Globus et al.
2007/0015874 A1 1/2007 Globus et al.
2007/0078209 A1 4/2007 Jozokos et al.
2008/0073105 A1 3/2008 Clark et al.
2011/0240336 A1 * 10/2011 Szylakowski et al. .... 174/120 C

FOREIGN PATENT DOCUMENTS

| | | |
|---|---|---|
| CA | 2206022 | 7/2001 |
| JP | 11025765 | 1/1999 |
| WO | 9732314 | 9/1997 |
| WO | 2007 041297 | 4/2007 |

OTHER PUBLICATIONS

International Search Report dated Sep. 7, 2012.

* cited by examiner

*Primary Examiner* — Chau N Nguyen
(74) *Attorney, Agent, or Firm* — Sofer & Haroun, LLP

(57) ABSTRACT

A cable is provided with a first twisted pair of insulated conductors having a first lay length and a first insulation resulting in a first signal propagation rate and a second twisted pair of insulated conductors having a second lay length and a second insulation resulting in a second signal propagation rate. The second signal propagation rate is faster than the first signal propagation rate resulting a first amount of signal skew between signals travelling through the first twisted pair and the second twisted pair. A jacket covers the pairs. Titanium dioxide is added to the insulation of the conductors of the second twisted pair so that the dielectric constant of the insulation of the conductors of the second twisted pair is raised, lowering the second signal propagation rate, resulting in a second amount of signal skew which is less than the first amount of signal skew.

7 Claims, 1 Drawing Sheet

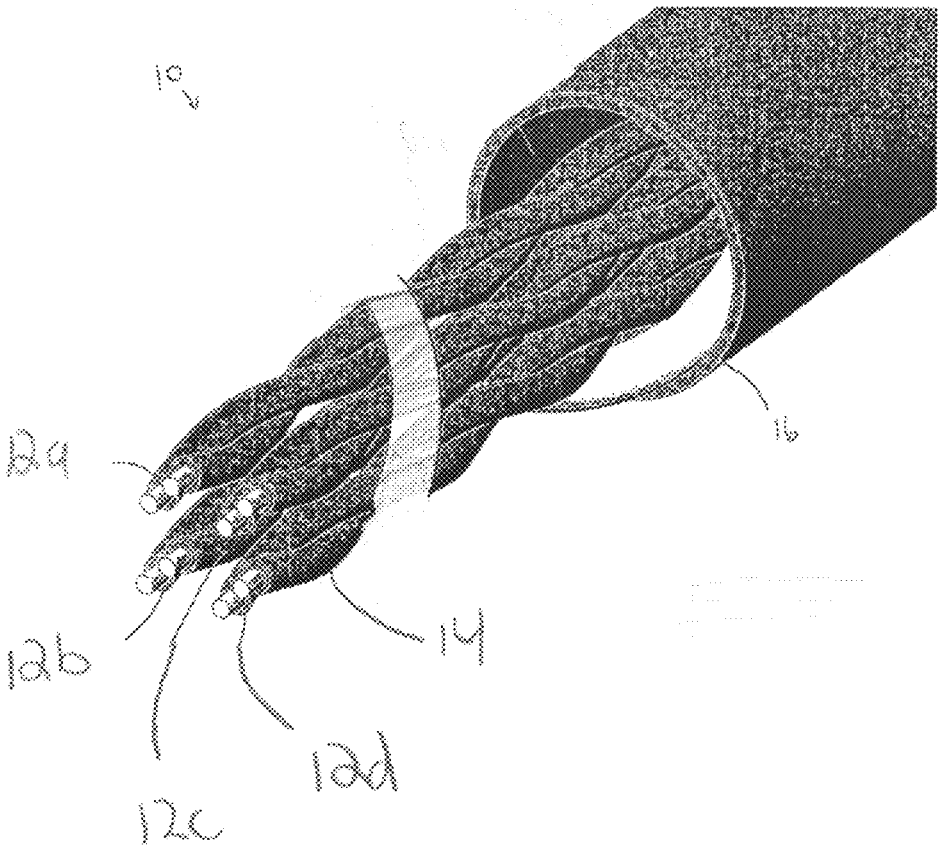
10
12a
12b
12c
12d
14
16

FEP MODIFICATION USING TITANIUM DIOXIDE TO REDUCE SKEW IN DATA COMMUNICATIONS CABLES

RELATED APPLICATION

This application is a continuation-in-part of co-pending U.S. patent application Ser. No. 12/846,880, filed on Jul. 30, 2010, the entirety of which is incorporated by reference.

BACKGROUND

1. Field of the Invention

The present arrangement relates to communication cables. More particularly, the present arrangement relates to data communication cables using modified insulation.

2. Description of the Related Art

In the communication industry, one type of a common communication cable is the LAN (Local Area Network) cable, formed from four pairs of conductors. The conductor pairs are made from two wires twisted around one another, commonly referred to as a twisted pair. Typical high speed communication cables may include a number of shielded or unshielded twisted pairs enclosed by an outer jacket.

One problem that typically confronts the construction of such cables is signal interference or crosstalk that can occur between twisted pairs within the cable as well as with interference from other signal sources outside the cable, in particular with unshielded twisted pairs running in adjacent cables. In order to reduce the incidences of cross talk, the twisted pairs in unshielded data communication cables have different twist rates from one another so that a typical four pair LAN cable will have 4 pairs each with a different twist rate.

However, due to the different twist rates for addressing crosstalk, another cable construction obstacle arises referred to as skew. For example, for any given length of cable, the same signal sent along two adjacent twisted pairs with different twist rates will reach the end of the cable at different times. This occurs because the twisting of one pair at a shorter lay length (higher twist rate) than another pair within the same cable will necessarily result in the physical conductor path in the shorter lay length pair being longer than the conductor path of the pair(s) with the longer lay length (slow rate of twist). This resultant time difference is known as skew.

For example, in a 1000' cable, each of the twisted pairs would exceed 1,000 feet in length because they are twisted. Assuming normal sized copper conductors/insulation for LAN cables, the typical lengths for the pairs would result in approximately 1,010 feet of wire needed for each wire in the fastest (longest lay length) pair, approximately 1,030 feet of wire needed for each wire in the slowest (shortest lay length) pair, with some amount in between needed for the other pairs.

As a result, a signal travelling down the longest lay length pair would arrive about 2% sooner than a signal travelling down the shortest lay length pair. According to most testing standards, there is a requirement that for a 100 meter length of cable 10, the time difference it takes for a signal to travel from one end of cable 10 to the other, between any two pairs cannot exceed 45 nanoseconds.

The property of skew and the associated signal/time difference is not influenced only by the physical length of the conductors in the various pairs. The insulation used on the pairs also affects the speed of signal propagation due to dielectric characteristics created by the insulation layer(s). This effect is a result of the communication signal passing in part through the insulation on the conductor pairs, slowing the propagation rates. Thus, in the longer (shorter lay length) pairs, the dielectric coupling of the signal to the insulation slows the propagation rates.

Moreover, each polymer used for insulation has its own dielectric constant. Certain polymers have low dielectric constants with a corresponding lesser effect on the signal speed. An example of such a polymer is FEP (Fluorinated Ethylene Propylene Copolymer). Other polymers such as Polypropylene have higher dielectric constants and thus exhibit a greater negative effect on the signal speed. This further exacerbates the skew problem. Many LAN cables employ two or more different types of insulation on the different pairs within the same cable.

One way the prior art has addressed the problem of skew is to increase the relative signal propagation velocity in the slower pairs by foaming the insulation used on those pairs. By foaming the insulation, the dielectric constant is reduced, thus allowing the signal in the slow pairs (pairs with shorter lay length) to be faster relative to the faster pair (pair with the longest lay length) reducing the overall signal velocity difference in the cable pairs and thus reducing skew.

However, the foaming process has a number of disadvantages; it is expensive, causes reduced manufacturing line speeds (slow extrusion), is difficult to control and ultimately yields high scrap rates. In addition, foamed insulation is easier to crush and thus may lead to the cables/pairs failing the necessary crush resistance testing. In fact, the foamed insulation may even overly compress/crush during twining (of the conductors into pairs). As a result, the insulation on the foamed pairs must be oversized to compensate. This increases the overall diameter of the cable which creates problems for the end user since smaller diameter cables are usually preferred.

One manner for overcoming these drawbacks is to manipulate the electrical properties of the conductor insulation in the twisted pairs by compounding additives into the polymer and extruding these compositions onto wire as a primary coating of plenum cable twisted pairs to obtain regularized electrical performance between the pairs in a cable. In this respect, instead of speeding up signal propagation in the slow pairs of a cable to reduce skew, as is the case in the prior art, the introduction of additives into the insulation in the fast pairs (longest lay length) reduces the signal propagation speed to even the propagation speed among the four pairs in a typical LAN cable thus reducing skew.

In this context, different additives had been used within the insulation of the fast pair, including but not limited to glass beads, talc, zinc oxide and calcium fluoride. Although these additives may exhibit certain advantageous electrical properties they otherwise negatively affect the processability (extrusion quality/speed etc. . . . ) of the insulation as well as having negative effects on the dissipation factor (the ratio of the power loss in a dielectric material to the total power transmitted through the dielectric.)

OBJECTS AND SUMMARY

The present invention overcomes these drawbacks by manipulating the electrical properties of some of the conductor insulation in the twisted pairs by compounding titanium dioxide into the polymer and extruding this composition onto wire as a primary coating of plenum cable twisted pairs to obtain regularized electrical performance between the pairs in a cable.

Instead of speeding up signal propagation in the slow pairs of a cable to reduce skew, as is the case in the prior art, the present arrangement introduces titanium dioxide into the insulation in the fast pairs (longest lay length) to reduce the signal propagation speed to reduce skew. The main electrical property of the fast pairs is being manipulated by modifying the insulation material to manipulate the dielectric constant of the conductor insulation.

The present invention uses typical extrusion processes, as opposed to foaming processes, thus yielding higher manufacturing line speeds, lower costs, better process control and reduced scrap rates. The crushing problem observed in the prior art with the foam products is greatly reduced and in many cases eliminated in the present arrangement and thereby permits the use of smaller diameter pairs which in turn reduces the size of the cable, yielding a preferred product for the end user.

To this end, the present arrangement is directed to a cable with a first twisted pair of insulated conductors having a first lay length and a first insulation resulting in a first signal propagation rate and a second twisted pair of insulated conductors having a second lay length and a second insulation resulting in a second signal propagation rate. The second signal propagation rate is faster than the first signal propagation rate resulting a first amount of signal skew between signals travelling through the first twisted pair and the second twisted pair. A jacket covers the pairs.

Titanium dioxide is added to the insulation of the conductors of the second twisted pair so that the dielectric constant of the insulation of the conductors of the second twisted pair is raised, lowering the second signal propagation rate, resulting in a second amount of signal skew which is less than the first amount of signal skew.

BRIEF DESCRIPTION OF THE DRAWINGS

The present invention can be best understood through the following description and accompanying drawings, wherein:

FIG. 1 shows an unshielded data communication cable having twisted pairs, in one embodiment.

DETAILED DESCRIPTION

In one arrangement, as shown in FIG. 1 a data communication cable 10 includes a plurality of twisted pair's 12*a*-12*d*, each pair having a different lay length and each pair covered with an insulation coating 14. The bundle of twisted pairs is cabled and enclosed within a jacket 16.

For the purposes of illustration, the present arrangement is described as a typical eight wire LAN cable composed of four twisted pairs 12*a*-12*d*. However, the invention is not limited in this respect. The principles of the present arrangement may be employed within smaller or larger number of twisted pair arrangements as well.

Regarding the material used for insulation 14 on each of pairs 12*a*-12*d*, the salient features of the present application may be employed in conjunction with any polymer used for primary insulation on LAN cables. However, for the purposes of illustration, in the present arrangement, insulation coating 14 on at least one twisted pair 12 is described as being FEP (Flouronated Ethylene Polymer). Insulation coating 14 on remaining pairs 12 may be made from FEP or may be made from any other desired insulation, including but not limited to PE (Polyethylene), PP (Polypropylene), PTFE (Polytetrafluoroethylene), ECTFE (Ethylene Chlorotrifluoroethylene), ETFE (Ethylene Tetrafluoroethylene), PEA, MFA, PPO (Polyphenylene Oxide), PPS (Polyphenylene Sulfide), PEEK (Polyether Ether Ketone), PET (Polyethylene Terephthalate), PBT (Polybutylene Terephthalate), PA (Polyimide ex. Nylon), PEI (Polyether Imide), PU (Polyurethane), TPE (Thermoplastic Elastomer), and TPV (Thermoplastic Vulcanizate). For the purposes of illustration, jacket 16 can be any typical polymer used for LAN cables or other similarly constructed cables.

As presented in the background section, in order to minimize cross-talk between adjacent twisted pairs 12 within LAN cable 10, adjacent twisted pairs 12 have varying twist rates, and thus have varying lay lengths. The varying lay lengths of twisted pairs 12 relative to one another, result in different conductor lengths per pair 12, per unit of length of cable 10, thus resulting in signals propagating through the various pairs to reach the end of cable 10 at different times.

In one embodiment, as shown in FIG. 1, cable 10 has four (4) twisted pairs 12*a*-12*d* each having a different lay length from one another. For example, in a typical LAN cable 10, that meets the standards of CAT 5e 4 pair UTP (Unshielded Twisted Pair), the lay lengths of pairs 12*a*-12*d* range from 0.5 inch (shortest lay length-slowest pair) to about 0.9 inch (longest lay length-fastest pair). As noted above, one pair, namely twisted pair 12*a*, has a high twist rate (shortest lay length of 0.5 inches), with adjacent twisted pairs 12*b*-12*d* each having lower twist rates (longer lay lengths of 0.55 inches (12*b*), 0.75 inches (12*c*), and 0.9 inches (12*d*). In this context, pair 12*a* are sometimes referred to as the "slow pair" and pair 12*d* may be referred to as the "fast pair"

It is noted that the above sample lay lengths are for illustration purposes only. Any series of different lay lengths within a LAN cable may utilize the features of the present arrangement.

As a result of the above sample lay lengths for pairs 12*a*-12*d*, assuming the same insulation 14 on all four pairs 12*a*-12*d*, a signal propagating along pair 12*a* (slow pair) will take longer to reach the end of cable 10 than the signals moving through pairs 12*b*-12*d*. In fact, pair 12*d* (fast pair), having the longest lay length will take the shortest amount of time to reach the end of cable 10. In this arrangement pair 12*a* exhibits the greatest difference with pair 12*d* (as well as differences with 12*b* and 12*c*) resulting in the cable skew.

It is important to remember that twist rate alone does not determine the speed at which as signal passes there through. Other factors, importantly the type of insulation 14, greatly affect the signal speed. As such, it is possible for a signal passing through pair 12*a* (the pair with the shortest lay length—which sometimes in the art is referred to as the "slow pair") to actually pass faster than through a pair 12 with a longer lay length, such as pairs 12*b*-12*d* if insulation 14 on the pairs 12 is different from one another and where such insulations 14 exhibit different dielectric constants.

According to the present arrangement, in order to reduce the skew in cable 10 between twisted pairs 12*a*-12*d* the insulation coating 14 is modified by the addition of an additive, which is extruded onto the fastest pair 12 (which ever pair 12*a*-12*d* that may be based on the twist rate+insulation 14 selection), increasing the dielectric constant of that fastest pair, thereby slowing down the velocity of signal propagation, so that the signal in fast pair 12, ultimately reaches the end of cable 10 closer in time to the slower pairs 12.

For example, in LAN arrangements that use FEP as insulation 14 on some or all of pairs 12*a*-12*d*, basic FEP has a dielectric constant of roughly 2.07. However, with the addition of 15% titanium dioxide, the effective dielectric constant of the FEP on pair 12*d* can be increased to 2.65 with little effect on the dissipation factor (dissipation factor is discussed in more detail below). An addition of 10% titanium dioxide raises the effective dielectric constant of the FEP on pair 12*d* to 2.49, again with little negative effect on the dissipation factor. This effective dielectric constant of the FEP on the fastest pair 12 can be adjusted by changing the percentage of titanium dioxide.

One property that is necessary to watch is the stability of the additive to the FEP insulation 14 on pair 12*d*, because FEP is extruded at a high temperature. For example, FEP has a high melting temperature, substantially ~260° C., and an even higher processing temperature, ~360° C. or above (to achieve a low enough viscosity for high speed extrusion).

However, most organic materials, including most polymers, deteriorate at these high temperatures making them unsuitable for use as an additive. However, in accordance with the present embodiments, the additive employed is an inorganic material, such as titanium dioxide, which can be used at very high temperatures, often above 500° C., making it advantageous for use as the additive from a processing standpoint. For example titanium dioxide may be used at processing temperatures well in excess of 500° C.

As such, in the present arrangement, an inorganic material such as titanium dioxide is used to adjust the dielectric constant of FEP in coating 14 of the fastest pair 12. Titanium dioxide has a lower cost as compared to the price of the FEP into which it is incorporated making this process cost effective. Additionally, unlike most organic polymers and polymer additives, titanium dioxide does not degrade the fire performance of FEP, which allows the cables to maintain their plenum rating, such as the fire rating associated with the NFPA 262 flame test.

Moreover, using an inorganic material, preferably titanium dioxide, as the FEP filler has other advantages. For example, when processing in excess of 500° C. there is no observed degradation such as precipitation of the filler, thus no foam is observed in the final coating layer. Additionally, the processability of compounds with titanium dioxide is such that the insulation extrusion line speed be maintained at a high level, near or at the same level as with FEP by itself, while the coating surface remains substantially smooth.

To this end, in a first arrangement, the electrical properties of FEP (or other fluoropolymers) are modified by introducing titanium dioxide into the polymer. In the present example, titanium dioxide is added in the amount of 7.5%-15% by weight. However, it is contemplated that variations in the percentage of titanium dioxide may range from 1% to 30% (where extrusion processing and equipment wear in manufacturing becomes problematic).

As shown in the following Table 1, the effect on electrical properties and dissipation factor are shown comparing raw FEP, FEP+10% titanium dioxide as well as a host of other FEP—inorganic additive materials. As shown in Table 1, FEP+10% titanium dioxide exhibits the best results.

TABLE 1

| | 100 MHz-500 MHz | |
|---|---|---|
| TE 9494 (FEP) filled with: | Dielectric Constant | Dissipation Factor, 10−4 |
| FEP - no additive | 2.07 | 1.79 |
| 10% TiO2 | 2.49 | 2.82 |
| 10% CaCO3 | 2.32 | 2.34 |
| 10% CaF2 | 2.29 | 7.24 |
| 10% Clay | 2.17 | 20.41 |
| 10% Hollow Glass Bead | 1.92 | 6.68 |
| 10% Mica | 2.21 | 3.39 |
| 10% Zinc Borate | 2.25 | 7.05 |
| 10% ZnO | 2.27 | 3.53 |
| 10% Talc | 2.19 | 2.65 |
| 10% Silica | 2.16 | 5.45 |

TABLE 1-continued

| | 100 MHz-500 MHz | |
|---|---|---|
| TE 9494 (FEP) filled with: | Dielectric Constant | Dissipation Factor, 10−4 |
| 10% Boron Nitride | 2.15 | 1.87 |
| 10% FP108 Fluoropolymer Compound | 2.07 | 13.5 |
| 10% Solid Glass Bead EMB10 | 2.27 | 6.06 |
| 10% Solid Glass Bead EMB20 | 2.32 | 7.63 |
| 10% Ultem PEI | 2.15 | 1.64 |
| 10% Siltem PEI + Siloxane Copolymer | 2.17 | 8.51 |

Applicants note that dissipation factor is another issue, apart from skew that needs to be monitored when making communication cables. The dissipation factor correlates with the insertion loss (attenuation) in a cable. As the dissipation factor increases, there is more signal loss in the cable. Excessive signal loss can lead for example, to a cable failing EIA-TA (Electronic Industries Alliance-Telecommunications Industry Association) requirements for insertion loss. Different additives used in coating/insulation 14 for pairs 12, in addition to changing the dielectric constant, may also negatively affect the dissipation factor. As shown above in Table 1, the titanium dioxide, in addition to raising the dielectric constant, does not show a significant increase in dissipation factor over the pure FEP.

Turning now to an exemplary arrangement showing an exemplary implementation of the present arrangement in a LAN cable 10, in a first prior art arrangement, a prototypical LAN cable is constructed having two (2) pairs 12 coated with FEP and two (2) pairs 12 coated with FR olefin (a Flame Resistant olefin). In this case, the FEP is used because of its ideal electrical properties as well as it superior fire resistance. However, in order to reduce costs, FR olefin is used on two (2) of the pairs.

The following Table 2 shows such a construction, the propagation speeds/times and the resulting skew measurements

TABLE 2

(time for a signal to cross 100 m or test cable)
2 x 2 construction

| Lay Length | Pair | Color | Ins. Type | Time Delay |
|---|---|---|---|---|
| Shortest | 12a | Blue | FEP | 469 ns |
| Longest | 12d | Orange | FR Olefin | 501 ns |
| Second Short | 12b | Green | FEP | 466 ns |
| Second Longest | 12c | Brown | FR Olefin | 504 ns |
| | | | SKEW | 38 ns |

In this example, the pair with the longest lay length 12*d* is "orange" (named after its color code); the second longest lay length is brown or pair 12*c*; the second shortest lay length is "green" or pair 12*b*; and the shortest lay length is "blue" or pair 12*a*. To keep skew low, the longest lay length two pairs 12 (based on the long lay length (12*d*—orange and 12*c*—brown), the FR olefin insulation is used. Likewise, on the shorter lay length pairs 12*b* (green) and 12*a* (blue), the better FEP is used. Because FEP insulation on pairs 12*b* and 12*a* has better dielectric properties than the FR olefin on pairs 12*c* and 12*d*, even though FEP is used on the shorter lay length pairs 12*a* and 12*b*, the test signals are actually faster than the test signals sent through the long lay length pairs 12*c* and 12*d*. This means that pairs 12*c* and 12*d*, which are sometimes referred to as the "fast' pairs based on their longer lay lengths are, in this example, actually slower than pairs 12*a* and 12*b* because of the different insulation types. In any event, the signal skew between the slowest and fastest pairs is 38 nanoseconds, which is within the test limit of 45 nanoseconds over 100 meters.

In order to reduce FEP usage, it is advantageous to make a third pair 12 using FR olefin instead of FEP, reducing the use of FEP to only one pair 12. Using prior art FEP formulations, the following Table 3 shows the result.

TABLE 3

(time for a signal to cross 100 m or test cable)
1 x 3 construction

| Lay Length | Pair | Color | Ins. Type | Time Delay |
|---|---|---|---|---|
| Shortest | 12a | Blue | FEP | 469 ns |
| Longest | 12d | Orange | FR Olefin | 501 ns |
| Second Short | 12b | Green | FR Olelin | 514 ns |
| Second Longest | 12c | Brown | FR Olelin | 504 ns |
| | | | SKEW | 45 ns |

The green pair or pair 12*b* is changed from FEP to FR olefin since this is the second shortest lay length pair 12, but is still longer than pair 12*a*, the blue pair. By doing so, this decreases the speed on this test pair 12*b* (green) from 466 nano seconds to 514 nanoseconds. Thus, the skew for this test sample has increased from 38 nanoseconds to 45 nanoseconds which is the upper test limit.

However, unlike the above example, the present arrangements is able to keep the use of three (3) FR olefin pairs 12 and one (1) FEP pair 12 while simultaneously reducing skew to 23 nanoseconds, even below the skew results for the first two (2) FEP and (2) FR olefin example from Table 2. For example, as shown in the following Table 4, the FEP insulation 14 on the fastest pair (12*a* having the shortest lay length—blue) is mixed with 7.5% by weight of titanium dioxide as explained above.

TABLE 4

(time for a signal to cross 100 m or test cable)
1 x 3 construction

| Lay Length | Pair | Color | Ins. Type | Time Delay |
|---|---|---|---|---|
| Shortest | 12a | Blue | FEP + 7.5% TiO2 | 491 ns |
| Longest | 12d | Orange | FR Olefin | 501 ns |
| Second Short | 12b | Green | FR Olefin | 514 ns |
| Second Longest | 12c | Brown | FR Olefin | 504 ns |
| | | | SKEW | 23 ns |

In this arrangement the blue pair or pair 12*a* is changed from FEP to FEP+7.5% $TiO_2$. By doing so, this decreases the speed on this test pair 12*a* (blue) from 469 nano seconds to 491 nanoseconds. Thus, the skew for this test sample has decreased from 45 nanoseconds, as shown in Table 3, to 23 nanoseconds which is well below the test limit.

The above example shows how the use of titanium dioxide as an FEP additive on insulation 14 of one of pairs 12 is used to reduce skew, all other considerations being equal. This arrangement provides more latitude in cable construction, particularly in the selection of materials for insulation 14, so that the electrical test parameters of skew can be managed without significantly negatively affecting the other aspects of cable 10.

In each of the above arrangements, it is noted that additional additives such as compatibilizers or lubricants may be added to the composition if necessary to help with the compatability between the FEP and the additives. For example, such additives would be typically added during the compounding process, and include fluorinated rubbers, acrylic rubbers, thermoplastic elastomers, fluorinated polymers, acrylic polymers, polycarbonate, and polyethylene, provided such additives do not significantly adversely affect the improved skew results achieved above. One such example is boron nitride, used to improve the processibility. The content of such boron nitride is substantially less than 1 percent, and ideally about 0.2 percent.

In another embodiment, instead of using additives to slow down the propagation velocity in only the fastest pair 12 of cable 10, it is contemplated that for better skew results for cable 10 the principles used above may be applied to other pairs such as the next fastest pair 12. This may be useful in cables attempting to meet more stringent testing/classification standards.

As a result of the above described features, the present arrangement, modifying the FEP composition of coating 14 for the fastest pair 12 provides a significant advantage over prior art LAN type data communication cables. The present arrangement prevents skew by slowing down the signal speed in the fastest twisted pair without compromising other physical/mechanical properties of the insulation and without adding expensive processing.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cable, comprising:

a first twisted pair of insulated conductors, said first twisted pair having a first lay length and a first insulation made from flame resistant olefin resulting in a first signal propagation rate;

a second twisted pair of insulated conductors, said second twisted pair having a second lay length and a second insulation made from a fluoropolymer resulting in a second signal propagation rate wherein said second signal propagation rate is faster than said first signal propagation rate, wherein titanium dioxide is included in the insulation of the conductors of said second twisted pair so that the dielectric constant of the insulation of the conductors of said second twisted pair is raised;

wherein there is a skew between signals travelling through said first twisted pair and said second twisted pair, and wherein said inclusion of said titanium dioxide in said insulation of the conductors of said second twisted pair results in said skew being lower than a skew that would result between said first twisted pair and a second twisted pair of the same said second lay length and said second insulation that does not have titanium dioxide; and at least one jacket covering said pairs.

2. The cable as claimed in claim 1, said cable further comprising third and fourth insulated twisted pairs, each of said third and fourth pairs having an insulation respectively, and each having a lay length between said first and said second lay length of said first and second pairs respectively.

3. The cable as claimed in claim 1 wherein the insulation of said second twisted pair is FEP.

4. The cable as claimed in claim 1, wherein the insulation of said second twisted pair further includes boron nitride at an amount of substantially 1% or less.

5. The cable as claimed in claim 1, wherein said titanium dioxide added to said insulation on the conductors of said second twisted pair is added in an amount such that it has no substantial effect on the dissipation factor of said insulation.

6. The cable as claimed in claim 1, wherein said titanium dioxide is substantially in the range of 1%-30% by weight.

7. The cable as claimed in claim 6, wherein said titanium dioxide is substantially in the range of 7.5%-15% by weight.

* * * * *